US009231314B2

(12) United States Patent
Peterson et al.

(10) Patent No.: US 9,231,314 B2
(45) Date of Patent: Jan. 5, 2016

(54) CONNECTOR ASSEMBLY AND METHOD FOR USING

(71) Applicant: R.A. Phillips Industries, Inc., Santa Fe Springs, CA (US)

(72) Inventors: Thomas Dale Peterson, Glendora, CA (US); Zhimin Guo, Cerritos, CA (US)

(73) Assignee: R.A. Philips Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 14/210,189

(22) Filed: Mar. 13, 2014

(65) Prior Publication Data

US 2014/0273606 A1 Sep. 18, 2014

Related U.S. Application Data

(60) Provisional application No. 61/798,982, filed on Mar. 15, 2013.

(51) Int. Cl.

| | |
|---|---|
| ***H01R 4/24*** | (2006.01) |
| *H01R 103/00* | (2006.01) |
| *H01R 13/447* | (2006.01) |
| *H01R 13/50* | (2006.01) |
| *H01R 13/58* | (2006.01) |
| *H01R 24/28* | (2011.01) |

(52) U.S. Cl.

CPC ..... *H01R 4/24* (2013.01); *H01R 13/447* (2013.01); *H01R 13/501* (2013.01); *H01R 13/5829* (2013.01); *H01R 24/28* (2013.01); *H01R 2103/00* (2013.01)

(58) Field of Classification Search

USPC ..... 439/391, 397, 495, 494, 596, 404, 470

See application file for complete search history.

(56) References Cited

U.S. PATENT DOCUMENTS

| | | | | |
|---|---|---|---|---|
| 3,761,865 | A | 9/1973 | Bomgaars et al. | |
| 3,879,099 | A * | 4/1975 | Shaffer | 439/397 |
| 4,269,466 | A * | 5/1981 | Huber | 439/467 |
| 4,759,723 | A * | 7/1988 | Siemon | 439/409 |
| 4,995,830 | A * | 2/1991 | Eckhaus | 439/409 |
| 5,154,632 | A * | 10/1992 | Ijiri | 439/394 |
| 5,586,905 | A * | 12/1996 | Marshall et al. | 439/463 |
| 5,785,548 | A * | 7/1998 | Capper et al. | 439/409 |
| 5,871,374 | A * | 2/1999 | Maney | 439/596 |
| 5,944,463 | A * | 8/1999 | Savage, Jr. | 439/419 |
| 6,146,198 | A * | 11/2000 | Maeda | 439/587 |
| 6,152,760 | A * | 11/2000 | Reeser | 439/409 |
| 6,312,282 | B1 * | 11/2001 | Blaha et al. | 439/402 |
| 6,383,013 | B1 * | 5/2002 | Ghesla et al. | 439/417 |
| 7,144,269 | B2 * | 12/2006 | Libby et al. | 439/409 |

(Continued)

OTHER PUBLICATIONS

International Search Report and Written Opinion dated Jul. 14, 2014 for corresponding International application No. PCT/US14/26791, 10 pgs.

*Primary Examiner* — Alexander Gilman

(74) *Attorney, Agent, or Firm* — Christie, Parker & Hale, LLP

(57) ABSTRACT

A connector assembly for providing electrical connection to an insulated conductive wire, the connector assembly including: a housing defining a channel for receiving the insulated conductive wire; a cover hinged to the housing and configured to close over the channel to cover the insulated conductive wire; and an electrically conductive pin having a first end in the channel and a second end in the housing beneath the channel.

20 Claims, 7 Drawing Sheets

(56) References Cited

U.S. PATENT DOCUMENTS

| | | | | |
|---|---|---|---|---|
| 7,494,364 | B2 * | 2/2009 | Sakamoto et al. | 439/395 |
| 7,572,140 | B2 * | 8/2009 | Szelag et al. | 439/405 |
| 7,604,498 | B2 * | 10/2009 | Mahajan | 439/410 |
| 7,871,299 | B2 * | 1/2011 | Kawasaki et al. | 439/669 |
| 7,934,941 | B2 * | 5/2011 | Hayauchi | 439/417 |
| 8,714,994 | B2 * | 5/2014 | Daily et al. | 439/344 |
| 2012/0184148 | A1 | 7/2012 | Byrne et al. | |

* cited by examiner

CONNECTOR ASSEMBLY AND METHOD FOR USING

CROSS-REFERENCED TO RELATED APPLICATIONS

This utility patent application claims the priority to and the benefit of U.S. Provisional Application Ser. No. 61/798,982, filed Mar. 15, 2013, and entitled Connector Assembly and Method for Using, the entire contents of which is incorporated herein by reference.

BACKGROUND

1. Field

Embodiments of the present invention are related to a connector assembly and a method for using the same.

2. Description of Related Art

In a variety of applications, it is desirable to provide electrical coupling between components that are manufactured and sold as part of separate products. For example, a first manufacturer may sell an aftermarket component configured to be mounted on or used in conjunction with a product built and sold by a second manufacturer. Or a product manufacturer may produce and market add-on components that can be used with or connected to a main product to improve the functionality of the main product.

In many instances, providing a reliable electrical connection between separately manufactured products can be difficult, time consuming, labor intensive, and may require specialized skills or equipment. For example, one common solution for electrically coupling two electronic components that do not have compatible connectors is to simply splice the electrical wires of the corresponding components together by removing insulating material around the wires, and either soldering or twisting the wires together. This method, however, typically requires multiple tools and additional materials (e.g., to strip the insulating material and solder the wires together), is relatively time consuming, the electrical connection may be unreliable if not formed properly. Additionally, merely soldering or twisting the wires together may result in a mechanical and electrical connection that is prone to breaking, vulnerable to environmental contaminants and water exposure, and aesthetically unattractive. Other solutions, such as connector assemblies designed to electrically couple wires together, can also require specialized tools and knowledge to operate. Accordingly, there is a need for an apparatus and method for quickly, reliably, and simply electrically coupling conductive wires between separate electrical components.

SUMMARY

Embodiments of the present invention provide a connector assembly that allows for a quick electrical connection when compared to other techniques and products for splicing wires.

One embodiment of the present invention is a connector assembly for providing electrical connection to an insulated conductive wire, the connector assembly including: a housing defining a channel for receiving the insulated conductive wire; a cover hinged to the housing and configured to close over the channel to cover the insulated conductive wire; and an electrically conductive pin having a first end in the channel and a second end in the housing beneath the channel.

The hinge may couple the cover to a first edge of the housing.

A clip may be coupled to the cover and configured to engage a second edge of the housing.

An angle between a side of the clip and a first internal surface of the cover coupled to the clip may be acute, and the clip may be configured to engage a slot at the second edge of the housing.

A second internal surface of the cover, which is substantially perpendicular to the first internal surface of the cover, may be configured to close over the channel to retain the insulated conductive wire.

The electrically conductive pin may further include: a pointed end in the channel and configured to pierce an insulating material of the insulated conductive wire; and a bracing section configured to brace against an internal surface of the housing to retain the electrically conductive pin.

A sealing material may be in the channel and around the electrically conductive pin and configured to create an environmental seal to substantially prevent external contaminants from compromising an electrical junction between the electrically conductive pin and the insulated conductive wire.

The cover may be configured to apply a force against the insulated conductive wire and in a direction toward the sealing material to create the environmental seal when the cover is closed.

A ridge may be at a bottom of the channel and may extend in a direction substantially perpendicular to a length direction of the channel to reduce lateral motion of the sealing material within the channel.

In some embodiments, the present invention is a connector assembly including: a housing defining a channel; a cover configured to cover the channel; a pin partially exposed in the channel and extending into the housing; and a conductive wire electrically coupled to the pin inside the housing and extending outside of the housing.

The cover may be coupled to the housing by a hinge.

The housing, the cover, and the hinge may be a single integral component.

A clip may be coupled to the cover and configured to engage a portion of the housing defining a slot.

A sealing material may be in the channel and around the pin and configured to create an environmental seal around the pin.

The sealing material may include an opening configured to allow the pin to extend from the channel through the opening in the sealing material and into the housing.

The sealing material may include a raised surface surrounding the pin.

The channel may be configured to receive an insulated conductive wire, and the cover may be configured to apply a force against the insulated conductive wire and toward the sealing material to create the environmental seal when the cover is closed.

The insulated conductive wire may have a width substantially equal to a width of the channel.

The pin may include: a pointed end in the channel configured to pierce an insulating material of the insulated conductive wire; and a bracing section configured to brace against an internal surface of the housing to retain the pin in the housing.

One embodiment of the present invention is a method of using a connector assembly including the steps of: providing a housing, the housing comprising a cover coupled by a hinge to a first edge of the housing and a pin in a channel of the housing and extending into the housing below the channel; aligning a conductive wire over the pin; pressing the conductive wire into the pin; and closing the cover over the conductive wire and the channel to retain the conductive wire within the channel, wherein the pressing or the closing cause the pin to pierce an insulating material of the conductive wire and electrically connect the pin to the conductive wire.

BRIEF DESCRIPTION OF THE DRAWINGS

A more complete appreciation of embodiments of the present invention, and many of the attendant features and aspects thereof, will become more readily apparent as the invention becomes better understood by reference to the following detailed description when considered in conjunction with the accompanying drawings in which like reference symbols indicate like components, wherein.

DETAILED DESCRIPTION

Embodiments of the present invention will now be described more fully with reference to the accompanying drawings, in which exemplary embodiments thereof are shown. The invention may, however, be embodied in many different forms and should not be construed as being limited to the embodiments set forth herein. Rather, these embodiments are provided so that this disclosure is thorough and complete, and will fully convey the concept of the present invention to those skilled in the art.

Embodiments of the present invention provide a connector assembly for quickly, efficiently, and reliably splicing wires of electrical components or products together. In particular, embodiments of the present invention include a rigid housing structure with a cable that extends into the housing at one end and may be electrically coupled to an external device or component at the other end. A plurality of conductive pins are electrically coupled to the cable inside the housing and extend outside of the housing into a channel configured to receive an external insulated wire. The external insulated wire can be pressed into the channel such that the conductive pins pierce its sheathing to electrically couple the external insulated wire to the cable. A cover may be closed over the channel to retain the external insulated wire within the channel and create an environmental seal around the junction between the conductive pins and the external insulated wire.

Figure 1:
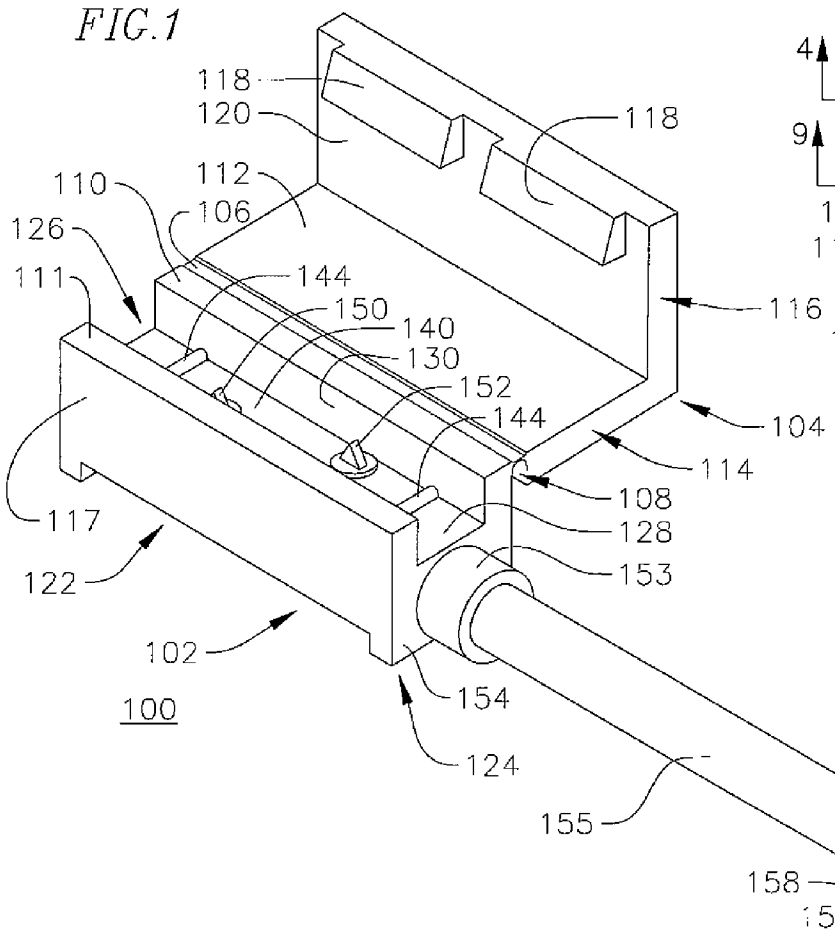
FIG. 1 illustrates a perspective view of a connector assembly of an embodiment of the present invention.

FIG. 1 shows a connector assembly 100 of an embodiment of the present invention for conveniently and quickly splicing a wire with a cable. The connector assembly 100 includes a housing 102 configured to receive an external wire (e.g., see FIG. 8). A cover 104 is attached or coupled to the housing 102 by a hinge 106, and is configured to close over the housing 102. The housing 102, the cover 104, and the hinge 106 may be integrally formed from a material having suitable insulating properties, and being capable of resisting deterioration from environmental and chemical contaminants. For example, the material may be a synthetic or semi-synthetic moldable solid material or organic polymer, such as plastic nylon, polypropylene, polyvinyl chloride (PVC), polystyrene, natural vulcanized rubber, or synthetic rubber.

The hinge 106 may be a living hinge that is integrally molded from the same material as the housing 102 and the cover 104, but has a reduced thickness compared to the housing 102 and the cover 104 to allow the hinge 106 to flexibly couple the housing 102 to the cover 104. In another embodiment, the housing 102, the cover 104, and the hinge 106 are formed as separate components, and are joined together by heating the material of the components above its melting temperature to chemically and mechanically bond the components, or by using an adhesive material or other mechanical connection mechanism.

The hinge 106 is coupled to an upper corner 108 of the housing 102 such that an upper surface 110 of the housing 102 may be substantially coplanar with an internal surface 112 of the cover 104 when the cover 104 is in an open position. In addition to the reduced thickness of the hinge 106, an internal surface of the hinge 106 may be vertically offset or recessed with respect to the upper surface 110 and the internal surface 112 to facilitate flexing of the hinge 106. In one embodiment, an upper surface 111 of the housing 102 opposite the hinge 106 may be slightly lower than (e.g., vertically offset with respect to) the upper surface 110 to facilitate closing the cover 104.

The cover 104 includes a first side 114, which includes the internal surface 112, and a second side 116 substantially perpendicular to the first side 114. When the cover 104 is closed over the housing 102, the first side 114 may lay substantially flat against, or adjacent, the upper surface 110. Additionally, when the cover 104 is in a closed position, the second side 116 may lay substantially flat against, or next to, a side surface 117 of the housing 102 that is substantially perpendicular to the upper surface 110 of the housing 102.

One or more teeth or clips 118 are located at an internal surface 120 of the second side 116, and are configured to engage with, or fit into, a slot 122 formed at a corner 124 of the housing 102 opposite (e.g., diagonal with respect to) the corner 108. The teeth 118 may be integrally formed with the cover 104 (e.g., molded as a single integral component), or may be formed as separate components and subsequently attached to the cover 104 by melting the materials, or by using an adhesive material or other mechanical attachment mechanism.

The housing 102 further includes a channel 126 that is formed to run along a center portion of the surface 110 of the housing 102. The channel 126 is configured to receive an external wire (e.g., external wire 188 of FIG. 8) for splicing to a cable within the connector assembly 100. A bottom surface 128 of the channel 126 is substantially parallel to a plane of the surface 110, but the bottom surface 128 is recessed or vertically offset with respect to the surface 110 such that the external wire can be placed within the channel 126 and the cover 104 can be closed over the channel 126 to have the internal surface 112 of the cover 104 contact the external wire and force the external wire toward the bottom surface 128 of the channel 126, thereby compressing the external wire between the bottom surface 128 and the internal surface 112. The channel 126 has internal walls 130 on opposing sides of the channel 126 that are substantially perpendicular the bottom surface 128 of the channel and the upper surface 110 of the housing 102. These internal walls 130 serve to confine the external wire in a lateral direction as the external wire is compressed between the bottom surface 128 and the internal surface 112.

The connector assembly 100 further includes a sealing material 140 located within the channel 126 between the walls 130 of the channel 126. The sealing material 140 may be made of a rubberized solid material that is pliable, flexible, stretchable, and capable of being compressed, such as natural rubber, synthetic rubber (e.g., nitrile rubber or silicone), or a suitable or other moisture resistant substance. The sealing material 140 is configured to facilitate formation of a water-resistant, or contaminant-resistant, seal around the electrical junction between an external wire and the connector assembly 100. In particular, the sealing material 140 may operate to prevent or reduce water or other environmental contaminants from entering the housing 102 or from interfering with the electrical connectivity of the connector assembly 100.

In the present embodiment, ridges 144 are respectively positioned on opposing ends of the sealing material 140, and extend between the opposing internal walls 130 of the channel 126. The ridges 144 may be formed as an integral molded component of the housing 102, or may be formed as separate components that can be attached to the housing 102 by melting the materials, or by using an adhesive material or other mechanical connection mechanism (e.g., inserted into a groove in the channel 126). The ridges 144 operate to prevent (or reduce) lateral motion of the sealing material 140 along the channel 126. Additionally, the ridges 144 may operate to provide opposing mechanical pressure against a subsequently inserted external wire after closing the cover 104 over the channel 126 and the wire (e.g., to pinch the external wire between the ridges 144 and the internal surface 112 of the cover 104). Thus, the ridges 144 may further facilitate formation of a water-resistant/contaminant-resistant seal between the housing 102 and an external wire. The pressure of the ridges 144 may also operate to stabilize or prevent motion of the subsequently inserted wire (e.g., using a shear force).

One or more conductive pins 150 and 152 extend from inside the body of the housing 102 through the sealing material 140 to be exposed within the channel 126. In particular, each of the pins 150 and 152 may have a pointed tip exposed in the channel 126 that are configured to pierce the sheathing or insulation material of a wire placed in the channel. Although the embodiment shown in FIG. 1 includes a pair of conductive pins 150 and 152, the number of conductive pins of other embodiments of the present invention may vary according to the design and function of the connector assembly 100. The conductive pins 150 and 152 may be formed from any suitable metal, metal alloy, or other conductive material with sufficient rigidity and conductive properties according to the design and function of the connector assembly 100, such as copper (Cu), gold (Au), tin (Sn), aluminum (Al), silver (Ag). In one embodiment, the conductive pins 150 and 152 include brass. The conductive pins 150 and 152 are also positioned within the channel 126 at locations chosen so that they will pierce the insulation or sheathing on an external wire placed within the channel 126 to make a positive and reliable electrical connection with the external wire.

A collar 153 is coupled to, or attached to, a side 154 of the housing 102 that is substantially perpendicular to the side surface 117 and the surface 128 of the housing 102. The collar 153 operates to provide structural support to a cable 155 that extends into the housing 102 and to relieve mechanical strain that might otherwise be applied to the cable 155. The collar 153 and the housing 102 may be integrally molded as a single component, or may be formed as separate components that are subsequently joined together by melting the materials or by using an adhesive or other mechanical attachment mechanism. In another embodiment, the collar 153 may be formed of a flexible material to reduce mechanical stress on the junction between the cable 155 and the housing 102.

The connector assembly 100 may have a length, which may be measured from an end of the collar 153 to an end of the connector assembly opposite the collar 153, that is approximately 2 inches or less, according to the design and function of the connector assembly. In one embodiment of the present invention, the connector assembly 100 has a length of approximately 1.7 inches. In another embodiment, the connector assembly 100 excluding the collar 153 has a length of approximately 1.5 inches.

The cable 155 may be electrically coupled to external electrical components at an end of the cable 155 opposite the housing 102. The other end of the cable 155 extends into the housing 102, and is electrically coupled to the pins 150 and 152, as will be described below. The cable 155 includes a plurality of wires 156 and 157, which are electrically insulated from each other within the cable 155 by sheathing 158 and sheathing 159, respectively. The wires 156 and 157 are respectively electrically coupled to the pins 150 and 152 within the housing 102, as will be shown in more detail below, and the number of wires within the cable 155 may vary in different embodiments of the present invention according to the design and function of the connector assembly 100 (e.g., the cable may consist of a single sheathed wire).

Figure 2:
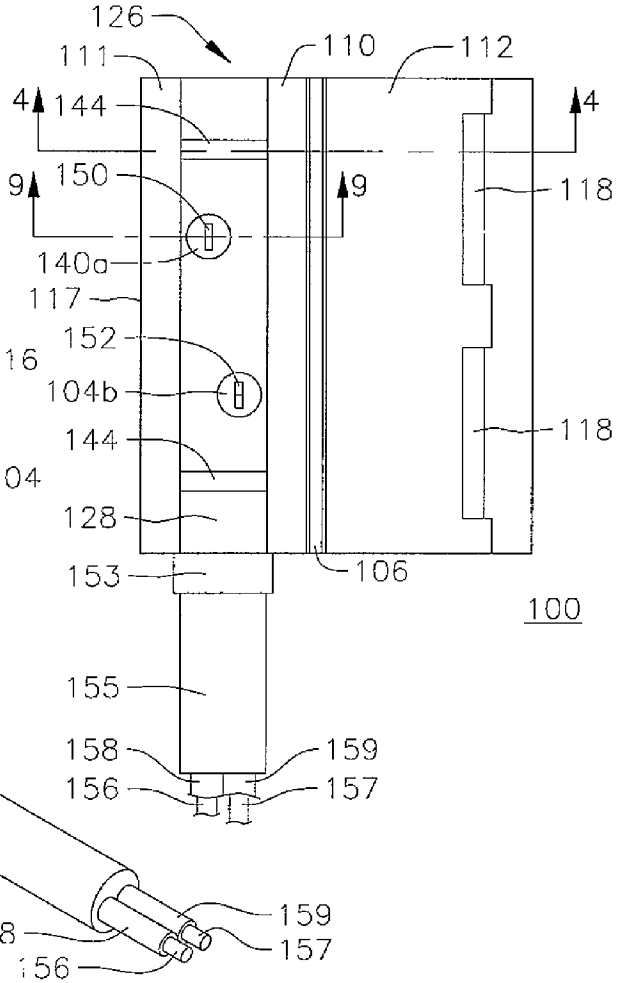
FIG. 2 illustrates a plan view of the connector assembly of the embodiment shown in FIG. 1.

FIG. 2 shows further detail of the connector assembly 100 and the channel 126 of the embodiment shown in FIG. 1 from a top, or plan, view. In particular, as shown in FIG. 2, the sealing material 140 of the present embodiment includes a first raised portion **140*a* and a second raised portion 140*b*, which are both laterally offset with respect to the center of the channel 126. The first raised portion 140*a* and the second raised portion 140*b* may be integrally formed as a single molded component with the remainder of the sealing material 140, or may be formed as separate components, such as grommets, which may be inserted into holes formed in the sealing material 140. The pin 150 extends through the first raised portion 140*a*, and is substantially aligned with an axis of the wire 156 of the cable 155. Similarly, the pin 152 extends through the second raised portion 140*b* and is substantially aligned with an axis of the wire 157. Thus, the pins 150 and 152 are laterally offset on opposite sides of a center axis (e.g., center axis A of FIG. 3A) of the channel 126. The first raised portion 140*a* surrounds the pin 150, and the second raised portion 140*b* surrounds the second pin 152, such that the first and second raised portions 140*a* and 140*b* facilitate formation of a seal around the pins 150 and 152 to prevent or reduce water or other contaminants from entering the housing 102 after placing an external wire in the channel 126 and closing the cover 104. Additionally, the first raised portion 140*a* and the second raised portion 140*b* are vertically offset above the remainder of the sealing material 140, thereby providing additional pressure against and around the pins 150 and 152 and a wire (e.g., cable 188 of FIG. 8) positioned in the channel 126 when the cover 104 is closed. Thus the first raised portion 140*a* and the second raised portion 140*b* of the sealing material 140 operate to improve the sealing effect around the pins 150 and 152, and further help to reduce or prevent motion of the wire within the channel once the cover 104** is closed.

Figure 3A:
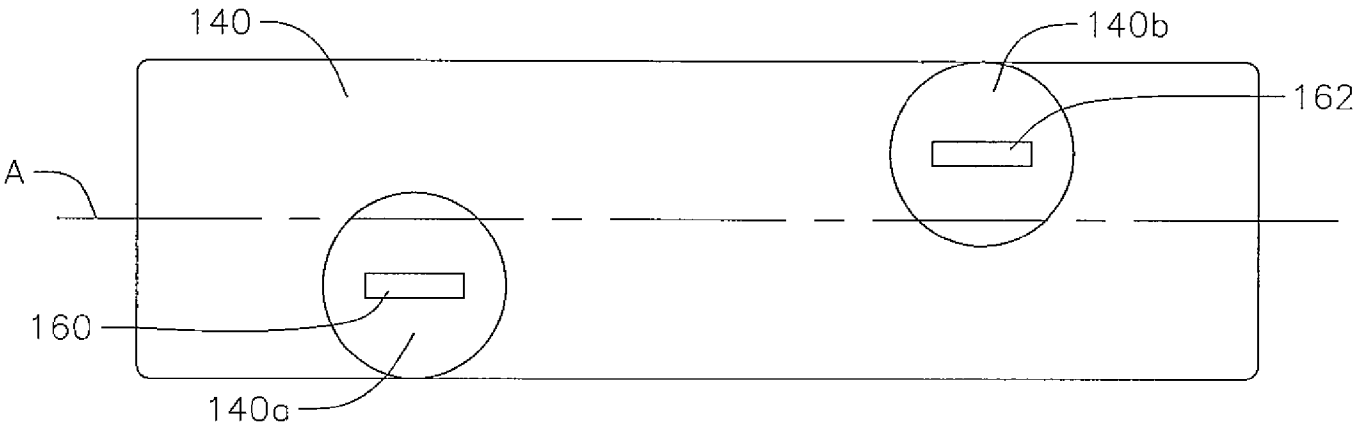
FIGS. 3A and 3B illustrate an enlarged view of a sealing material for the connector assembly of the embodiment shown in FIG. 1.

FIG. 3*a* shows an enlarged top view, or plan view, of the sealing material 140. In particular, the sealing material 140 has a generally rectangular shape or footprint with generally rounded corners, however, the footprint of the sealing material 140 may vary in other embodiments of the present invention according to the design and function of the connector assembly 100. The first raised portion 140*a* and the second raised portion 140*b* are laterally offset such that the centers of the first and second raised portions 140*a* and 140*b* lie on opposite sides of the center axis A of the sealing material 140. The first raised portion 140*a* and the second raised portion 140*b* each have openings or holes 160 and 162, respectively, which extend through the sealing material 140 and are configured to receive the conductive pins 150 and 152.

Figure 3B:
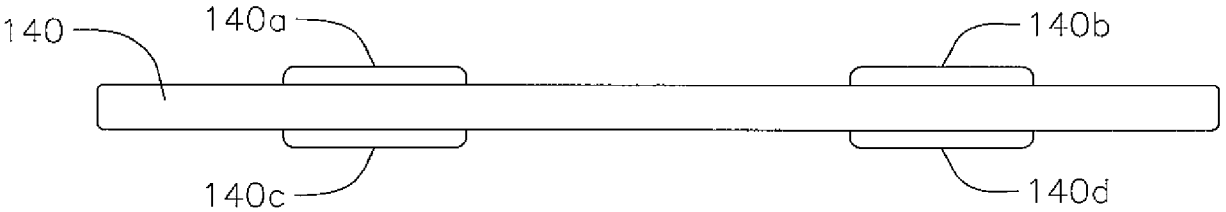

FIG. 3*b* shows an enlarged side view of the sealing material 140. As shown in FIG. 3*b*, the sealing material 140 may include raised portions 140*c* and 140*d* corresponding to (e.g., within or overlapping a footprint of) the raised portions 140*a* and 140*b*, respectively. The raised portions 140*a*-140*d* are each vertically offset with respect to the portion of the sealing material 140 away from the raised portions 140*a*-140*d*. The raised portions 140*c* and 140*d* may be configured to be inserted into recesses formed in the housing 102 to prevent or reduce lateral motion of the sealing material 140 within the channel 126.

Figure 4:
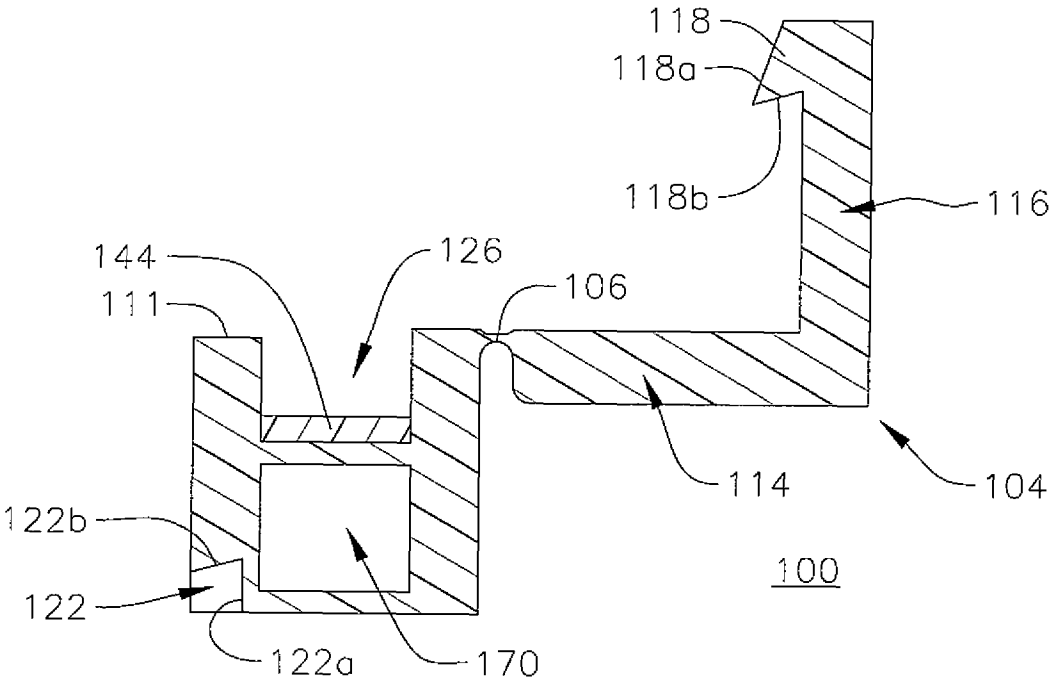
FIG. 4 shows a cross-sectional view of the connector assembly illustrating an internal cavity of a housing taken along the line 4-4 in FIG. 2.

FIG. 4 illustrates a cross sectional view of the connector assembly 100 taken along the line 4-4 shown in FIG. 2. As shown in FIG. 4, the clip 118 may have an acute angle such that an angle between a first surface 118*a* and a second surface 118*b* of the clip 118 is less than 90 degrees. For example, in the present embodiment, the angle between the first surface 118*a* and the second surface 118*b* of the clip 118 is approximately equal to 55 degrees. The slot 122, which is at a corner or edge of the housing 102 opposite the hinge 106, is configured to receive the clip 118. That is, the clip 118 is configured to snap into, or engage with, the slot 122. Accordingly, an angle between the internal surfaces 122*a* and 122*b* of the slot 122 is greater than or equal to an angle between the surfaces 118*a* and 118*b* of the clip 118. In the present embodiment, the angle between the internal surfaces 122*a* and 122*b* is equal to approximately 75 degrees. FIG. 4 further shows an internal cavity 170 within the body of the housing 102. The cavity 170 is beneath or below (e.g., within a footprint of) the channel 126. The cavity 170 is configured to receive and contain the cable 155 and portions of the pins 150 and 152 shown, for example, in FIG. 1.

Figure 5:
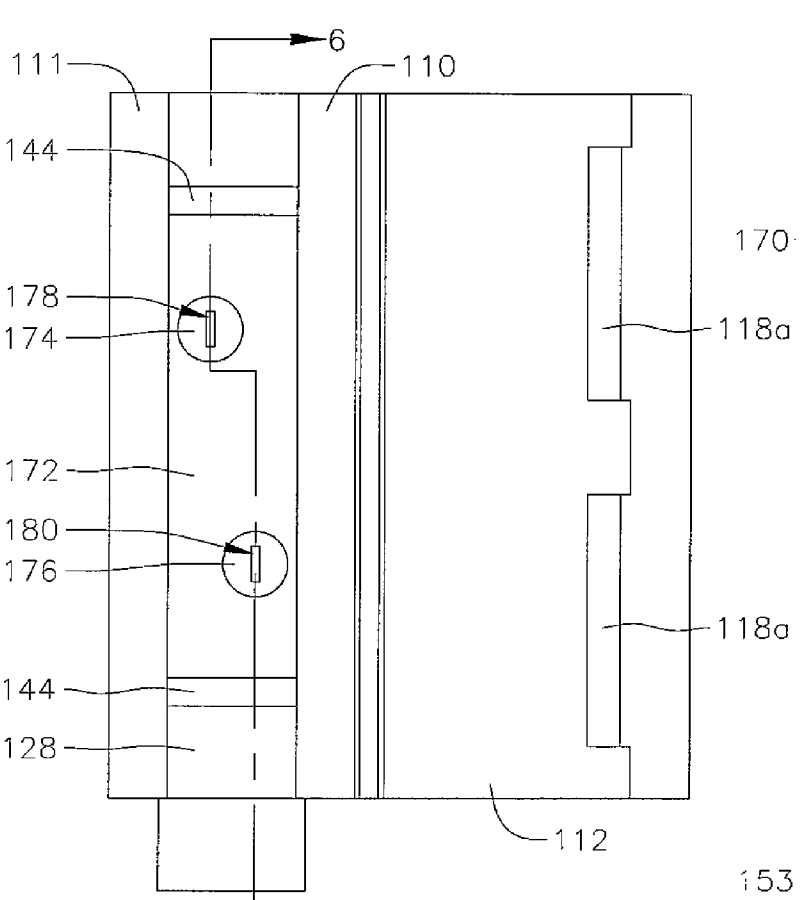
FIG. 5 shows a top view of the connector assembly of the embodiment shown in FIG. 1 with a portion of the housing beneath the sealing material exposed.

FIG. 5 illustrates a top or plan view of the connector assembly 100 of the present embodiment that is similar to the view shown in FIG. 2, but with the sealing material 140 removed to expose a surface 172 of the housing 102 beneath the sealing material 140. The surface 172 of the housing 102 may be coplanar or recessed with respect to the surface 128. A plurality of recesses 174 and 176 are formed in the housing 102 at the surface 172. The recesses 174 and 176 are configured to respectively receive the raised portions 140*c* and 140*d* of the sealing material 140 such that the cross-sectional width or diameter of the recesses 174 and 176 is substantially equal to the corresponding width or diameter of the raised portions 140*c* and 140*d*. A plurality of openings 178 and 180 are formed through the housing 102 within a footprint of the recesses 174 and 176, respectively. The openings 178 and 180 extend through the housing 102 to the cavity 170, and are configured to receive the conductive pins 150 and 152 such that the conductive pins 150 and 152 extend from the cavity 170 to the channel 126, as will be shown below.

Figure 6:
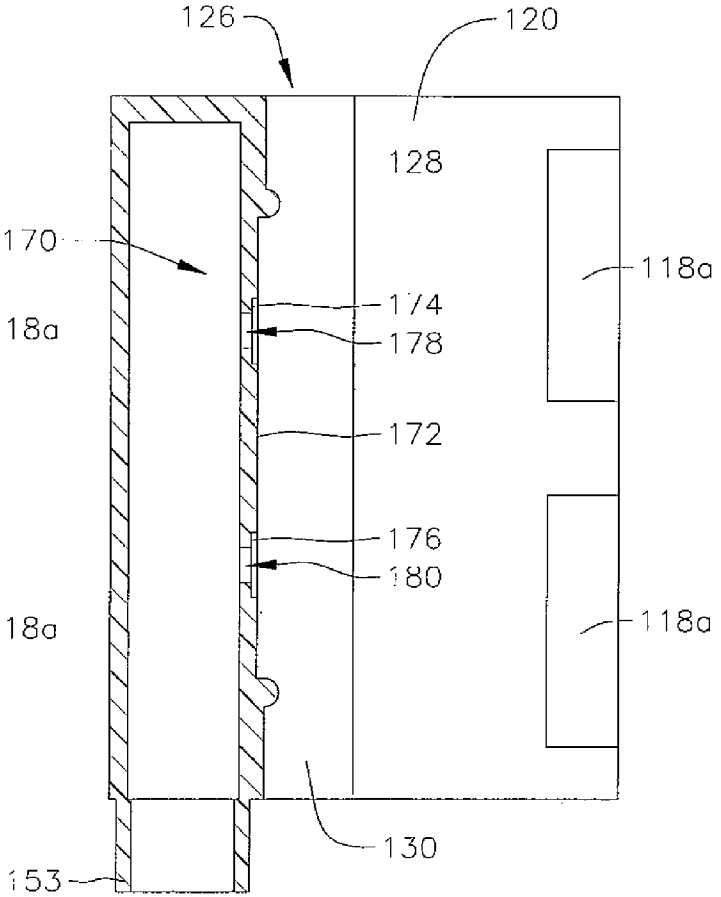
FIG. 6 illustrates a cross-sectional view of the connector assembly taken along the line 6-6 in FIG. 5.

FIG. 6 shows a cross-sectional view of the connector assembly 100 from FIG. 5 taken along the line 6-6. As shown in FIG. 6, the cavity 170 is within the housing 102 and may be within a footprint of the channel 126. The cavity 170 is configured to allow the cable 155 shown in, for example, FIG. 1, to extend through the collar 153 into the housing 102, such that the housing 102 substantially surrounds or encloses an end of the cable 155. The openings 178 and 180 extend through the recesses 174 and 176 in the housing 102 to allow the conductive pins 150 and 152 to pass from the cavity 170 to the channel 126.

Figure 7:
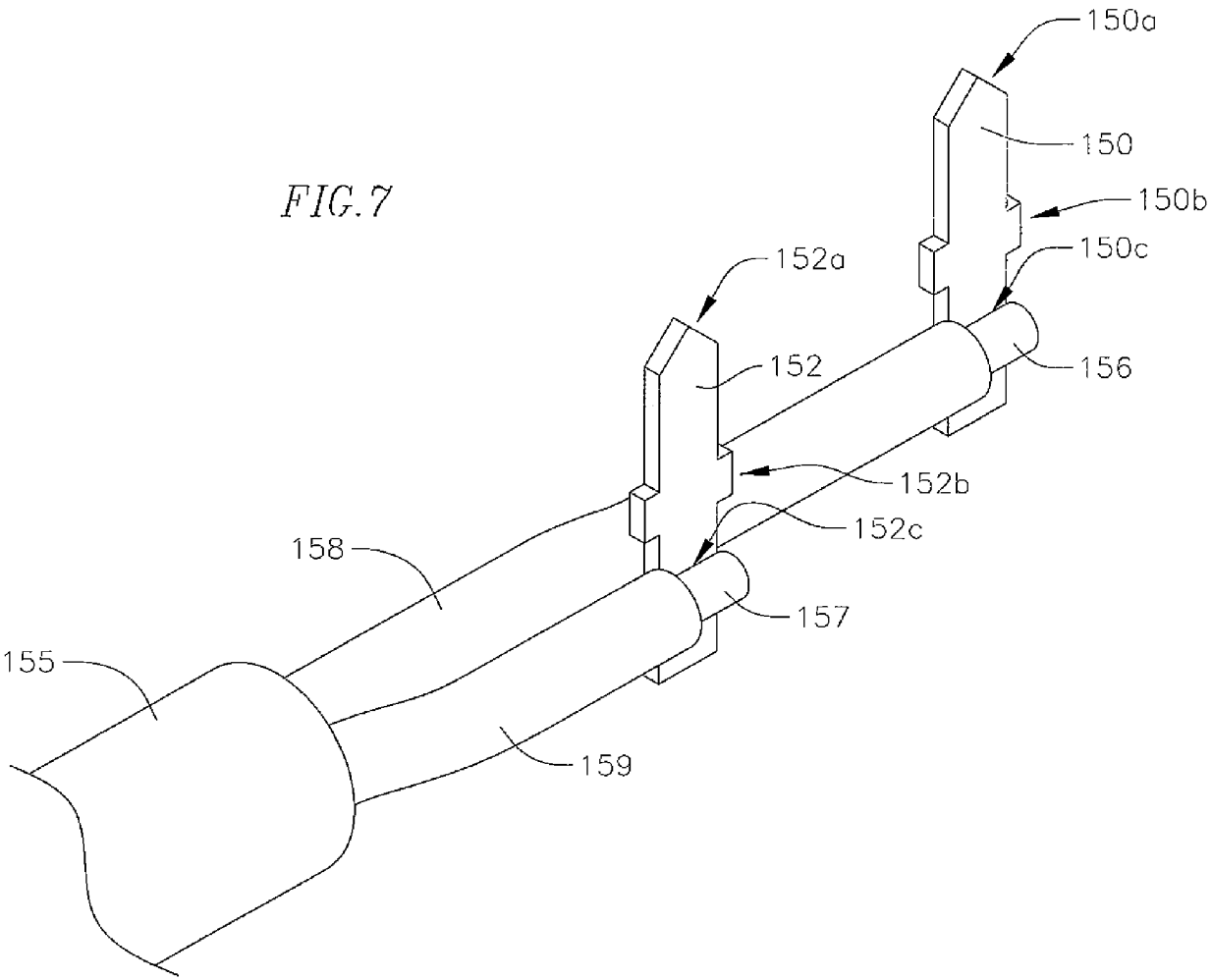
FIG. 7 illustrates an enlarged view of a cable that extends into the housing of the connector assembly of the embodiment shown in FIG. 1 with pins coupled to the cable.

FIG. 7 illustrates a perspective view of the end of the cable 155 inserted/extending into the housing 102 and coupled to the conductive pins 150 and 152. In particular, FIG. 7 illustrates that the wire 156 may extend further than the wire 157 of the cable 155 to enable the wire 156 to extend to a point below the opening 178 shown in FIG. 5. The conductive pins 150 and 152 may include pointed ends 150*a* and 152*a*, respectively, which are capable of piercing a sheathing or insulating material surrounding a conductive wire subsequently placed in the channel 126. For example, an angle of the pointed ends 150*a* and 152*a* may be less than or equal to 90 degrees.

Each of the conductive pins 150 and 152 may further include a bracing section 150*b* and 152*b*, respectively. The bracing sections 150*b* and 152*b* may be configured to brace the conductive pins 150 and 152 against an internal surface of the housing 102 to retain a portion of the conductive pins 150 and 152 within the housing 102, and to reduce or prevent incidences of the conductive pins 150 and 152 sliding out of the housing 102. Accordingly, a cross-sectional width of the bracing sections 150*b* and 152*b* may be greater than the cross-sectional width of the openings 176 and 178 formed in the housing 102. Additionally, the bracing sections 150*b* and 152*b* may be substantially perpendicular with respect to the height direction of the conductive pins 150 and 152, such that the conductive pins 150 and 152 generally have a shape of a cross, or are generally t-shaped.

Additionally, as shown in FIG. 7, the sheathings 158 and 159 are not present at or are removed from the ends of the wires 156 and 157, and the wires 156 and 157 are exposed. The exposed portions of the wires 156 and 157 are attached to lower portions 150*c* and 152*c* of the conductive pins 150 and 152, respectively, such that the conductive pin 150 can be electrically coupled to the wire 156, and such that the conductive pin 152 can be electrically coupled to the wire 157.

The lower portions 150*c* and 152*c* of the conductive pins 150 and 152 may be electrically coupled to the conductive wires 156 and 157 using any suitable electrical coupling technique, such as soldering, welding, sonic welding, crimping, or a mechanical mechanism for holding the conductive materials in physical contact. Thus, the electrical connection between the lower portions 150*c* and 152*c* of the conductive pins 150 and 152 and the conductive wires 156 and 157 may include additional intervening or external components.

In the embodiment shown in FIG. 7, the conductive pins 150 and 152 have a generally flat or flattened shape. In other words, a depth or thickness of the conductive pins 150 and 152 (e.g., measured in a direction extending from a first surface of the conductive pins 150 and 152 that contacts the conductive wires 156 and 157 to a second surface of the conductive pins 150 and 152 opposite the first surface) is less than a width of the conductive pins 150 and 152 (measured in a direction perpendicular to the depth or thickness direction).

Figure 8:
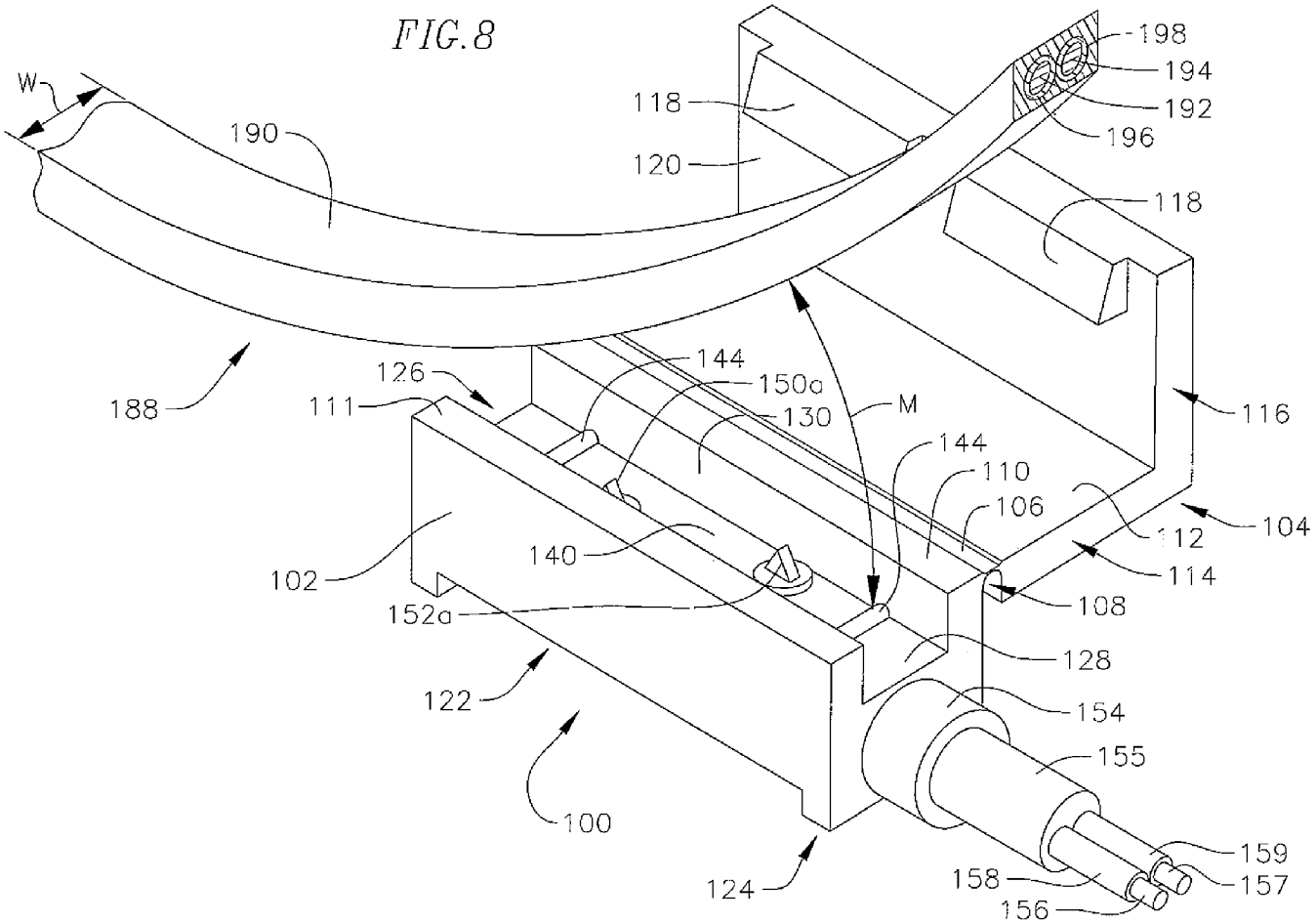
FIG. 8 illustrates the channel of the housing of the connector assembly of the embodiment shown in FIG. 1 receiving an external insulated wire.

FIG. 8 illustrates a perspective view of the assembly from FIG. 1 with a wire or cable assembly 188 to be positioned in the channel 126, as indicated by the motion arrow "M." The wire 188 may be configured to be repeatedly inserted and removed from the channel 126, such that the connector assembly 100 is reusable to electrically connect (i.e., splice) or disconnect the cable 155 with different components. When the wire 188 is removed from the channel 126, the conductive pins 150 and 152 are pulled out of the wire 188, permitting the insulation on the surface of the wire 188 to re-close and thereby re-seal the wire 188 at the locations where it was penetrated by the conductive pins 150 and 152. As discussed above, with respect to FIG. 7, the conductive pins 150 and 152 may have a generally flattened shape (e.g., the thickness of the pins 150 and 152 may be less than the width), which may facilitate the re-sealing or "healing" of the insulation of the wire 188.

The wire 188 has a cross-sectional width "W" substantially equal to, or nearly equal to, a width of the channel 126 (e.g., defined by a distance between opposing internal walls 130). In one embodiment, the wire 188 has a cross-section of approximately ¼ inches by 3/16 inches. The wire 188 includes an external sheathing or insulating material 190 configured to electrically insulate and protect the internal conductive wires 192 and 194. Each of the internal conductive wires 192 and 194 may further be electrically insulated from each other, and may be surrounded by sheathing or insulating material 196 and 198, respectively. The wire 188 may be any suitable wire or cabling according to the design and function of the connector assembly 100 such that the internal conductive wires of the wire 188 align with the conductive pins 150 and 152 when the wire 188 is placed into the channel 126. For example, in one embodiment, the wire 188 may be a 2×1.55 millimeter (mm) square cable, or a 2×0.75 mm square cable.

As the wire 188 is aligned with, and placed into, the channel 126 by a user of the connector assembly 100, the internal conductive wires 192 and 194 are aligned with the conductive pins 150 and 152, respectively. That is, the conductive pins 150 and 152 are spaced apart or laterally offset at predetermined positions within the channel 126 such that they align with the conductive wires 192 and 194, respectively, when the cable 188 is inserted into the channel 126. In other words, the positions of the conductive pins 150 and 152 within the channel 126 are predetermined to correspond with the positions of the conductive wires 192 and 194 within the wire 188. Thus, when the wire 188 is inserted into the channel 126, the conductive pins 150 and 152 are relatively easily electrically coupled to the conductive wires 192 and 194, respectively, with minimal effort on the part of the user of the connector assembly 100 to properly align the wire 188 with the conductive pins 150 and 152. The pointed tips 150*a* and 152*a* of the conductive pins 150 and 152 pierce the sheathing 190, 196, and 198 as the wire 188 is pressed into the channel 126, enabling the conductive pins 150 and 152 to be respectively electrically coupled to the conductive wires 192 and 194. Thus, after pressing the wire 188 into the channel 126, the conductive wire 156 is electrically coupled to the conductive wire 192 through the conductive pin 150, and the conductive wire 157 is electrically coupled to the conductive wire 194 through the conductive pin 152.

Figure 9:
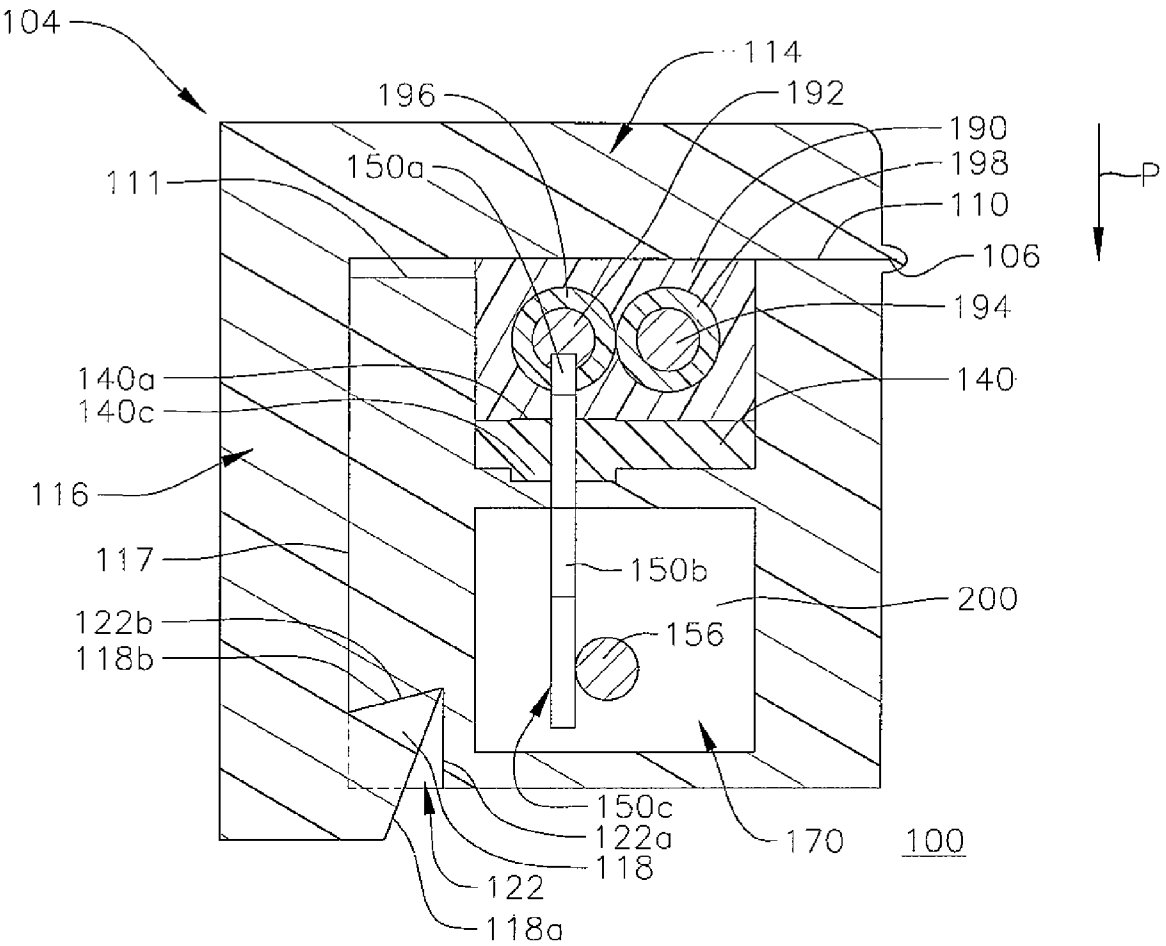
FIG. 9 shows a cross-sectional view of the housing of the connector assembly of the embodiment shown in FIG. 1 after placing the insulated wire in the channel and closing a cover of the housing over the channel.

FIG. 9 illustrates a cross-sectional view of the connector assembly taken along the line 9-9 of FIG. 2 after the wire 188 is positioned in the channel 126 and the cover 104 is closed over the channel 126. After closing the cover 104, the first side 114 of the cover 104 exerts a downward pressure or force "P" against the wire 188 such that the wire 188 is pressed/compressed into the raised portions 140*a* and 140*b* of the sealing material 140, thereby causing the raised portions 140*c* and 140*d* to correspondingly be pressed/compressed into the recesses 174 and 176. Additionally, the clip 118 is shown engaged with the slot 122 formed at an edge or corner of the housing 102 opposite the hinge 106. After the clip 118 engages with the slot 122, the surface 118*b* of the clip 118 is adjacent the surface 122*b* of the slot 122. An angle between the surface 122*b* of the slot 122 and the side surface 117 of the housing 102 may be acute such that the clip 118, after snapping into or engaging with the slot 122 resists being removed from the slot 122 to open the cover 104. For example, the forces exerted on the housing 102 by the cover 104 effectively cause the cover 104 to clasp the housing 102, thereby making it difficult for the clip 118 to accidentally or undesirably become disengaged with the slot 122, thereby improving the reliability of the connector assembly 100. Further, in the illustrated embodiments, the inter-fitting angled surfaces of the clip 118 and the slot 122 create a strong interference fit to securely retain the cover 104 in the closed position of FIG. 9. Additionally, in the embodiment shown in FIG. 9, the upper surface 111 of the housing 102 opposite the hinge 106 may be slightly lower than (e.g., vertically offset with respect to) the upper surface 110 of the housing 102 to facilitate closing the cover 104 and to allow sufficient clearance for the clip 118 around the upper surface 111.

Because the cover 104 is hinged to the housing 102 via the hinge 106, the connector assembly 100 does not have multiple components or pieces that must be managed or secured by a user. Additionally, the cover 104 may be relatively easily closed over the channel 126 without requiring the use of additional tools (e.g., clamps, pliers, etc.) to force the clips 118 to engage with the slot 122. However, the clips 118 on the cover 104 may also be relatively easily disengaged from the slot 122 by pressing against the cover 104 (e.g., at a portion of first surface 118*a*) in a direction away from the housing 102, thereby allowing a user to open the cover 104 to remove the wire 188 from the connector assembly 100. Furthermore, in the present embodiment, and referring to FIGS. 1, 2, and 4, because a space exists between the plurality of clips 118, a tool, such as a flathead screwdriver, may be inserted between the clips to exert a force against the internal surfaces 120 and 122*a* to pry the cover 104 apart from the housing 102. Thus, the connector assembly 100 provides a quick, reliable, and reusable method of splicing conductive wires to the cable 155, in a way that is environmentally protected, resistant to damage or mechanical stress, and is aesthetically pleasing.

FIG. 9 further shows the conductive pin 150 extending from the channel 126 into the cavity 170. The lower portion 150*c* of the conductive pin 150 is attached, or coupled, to the conductive wire 156 of the cable 155, such that the conductive pin 150 is electrically coupled to the conductive wire 156 within the cavity 170. The pointed tip 150*a* of the conductive pin 150 extends through the housing 102 and through the sealing material 140 and into the channel 126, and pierces through the sheathing 190 and 196 such that the conductive pin 150 is electrically coupled to the conductive wire 192. The conductive pin 152 is similarly configured to be electrically coupled between the conductive wire 194 and the conductive wire 157. The bracing section 150*b* of the conductive pin 150 braces the conductive pin 150 against the housing 102 at the top of the cavity 170 to prevent the conductive pin 150 from sliding out of the cavity 170.

An insulating material 200 may be subsequently deposited or injected into the cavity 170 to electrically insulate the conductive pins 150 and 152, and to provide additional structural support to the internal components of the connector assembly 100. The insulating material 200 may be any suitable material having sufficient insulating and curing properties. For example, in one embodiment of the present invention, the insulating material 200 may be the same material as the housing 102. In another embodiment of the present invention, the cable 155 and the conductive pins 150 and 152 are coupled together and inserted into a mold to form the housing 102 around the cable 155 without having an internal cavity 170 (e.g., the insulating material 200 and the housing 102 are molded as a single integral component around the cable 155 and the conductive pins 150 and 152).

Accordingly, embodiments of the present invention enable a user to quickly and reliably couple an external conductive wire to a cable or wire using the connector assembly 100. For example, the wire 188 can be relatively easily coupled to the cable 155 by inserting the wire 188 into the channel 126, and by then pressing the wire 188 against the conductive pins 150 and 152 to cause the pins 150 and 152 to pierce the sheathing around the conductive wires 192 and 194. In one embodiment, the conductive wire 188 is specially formed to have a rectangular cross-section, which facilitates proper alignment of the conductive wire 188 within the channel 126 such that the internal conductive wires 192 and 194 are correspondingly aligned with the conductive pins 150 and 152, respectively. The cover 104 can be closed over the channel 126 and the wire 188 such that the clips 118 engage with, or snap into, the slot 122 formed at an edge of the housing 102 opposite the hinge 106. Because the conductive pins 150 and 152 have pointed tips 150*a* and 152*a*, the connector assembly 100 reduces the need for tools to strip (e.g., remove insulating material from) the wire 188. Furthermore, the connector assembly 100 may not require additional tools to electrically couple the wire 188 to the cable 155. The cover 104 may be relatively easily opened and closed over the channel 126 and the wire 188 to allow repeated use of the assembly 100 or repositioning or replacement of the wire 188.

Collectively, components of the connector assembly 100 including the housing 102, the cover 104, the insulating material 140, and the conductive pins 150 and 152 operate to prevent motion of the wire 188 within the connector assembly 100, thereby forming a reliable mechanical and electrical coupling between the wire 188 to the cable 155. Additionally, the connector assembly 100 reduces or prevents external contaminants from entering the electrical junction between the wire 188 and the connector assembly 100 by forming an environmental seal around the conductive pins 150 and 152 between the conductive wire 188 and the connector assembly 100 using the sealing material 140.

It will be recognized by those skilled in the art that various modifications may be made to the illustrated and other embodiments of the invention described above, without departing from the broad inventive step thereof. It will be understood therefore that the invention is not limited to the particular embodiments or arrangements disclosed, but is rather intended to cover any changes, adaptations or modifications which are within the scope and spirit of the invention as defined by the appended claims and their equivalents.

What is claimed is:

1. A connector assembly for providing electrical connection to an insulated conductive wire, the connector assembly comprising:

a housing having a first side portion and a second side portion parallel to the first side portion, the first and second side portions defining a channel therebetween for receiving the insulated conductive wire, the first side portion having a first upper surface, the second side portion having a second upper surface lower than the first upper surface and having a flat side surface extending downwardly from the second upper surface;

a cover hinged to the first side portion adjacent the first upper surface, and configured to close over the channel to cover the insulated conductive wire and the flat side surface; and an electrically conductive pin having a first end in the channel and a second end beneath the channel.

2. The connector assembly of claim 1, further comprising a hinge coupling the cover to a first edge of the housing adjacent the first upper surface.

3. The connector assembly of claim 2, wherein the cover comprises a clip configured to engage a second edge of the housing adjacent a lower end of the flat side surface.

4. The connector assembly of claim 3, wherein an angle between a side of the clip and a first internal surface of the cover coupled to the clip is acute, and wherein the clip is configured to engage a slot at the second edge of the housing.

5. The connector assembly of claim 4, wherein a second internal surface of the cover, which is substantially perpendicular to the first internal surface of the cover, is configured to close over the channel to retain the insulated conductive wire.

6. The connector assembly of claim 1, wherein the electrically conductive pin further comprises:

a pointed end in the channel and configured to pierce an insulating material of the insulated conductive wire; and a bracing section configured to brace against an internal surface of the housing to retain the electrically conductive pin.

7. The connector assembly of claim 1, further comprising a sealing material in the channel and around the electrically conductive pin and configured to create an environmental seal to substantially prevent external contaminants from compromising an electrical junction between the electrically conductive pin and the insulated conductive wire.

8. The connector assembly of claim 7, wherein the cover is configured to apply a force against the insulated conductive wire and in a direction toward the sealing material to create the environmental seal when the cover is closed.

9. The connector assembly of claim 7, further comprising a ridge at a bottom of the channel and extending in a direction substantially perpendicular to a length direction of the channel to reduce lateral motion of the sealing material within the channel.

10. A connector assembly, comprising:

a housing having a first side portion and a second side portion parallel to the first side portion, the first and second side portions defining a channel therebetween, the first side portion having a first upper surface, the second side portion having a second upper surface lower than the first upper surface and having a flat side surface extending downwardly from the second upper surface;

a cover hinged to the first side portion adjacent the first upper surface, and configured to cover the channel and the flat side surface;

a pin partially exposed in the channel and extending into the housing; and a conductive cable electrically coupled to the pin inside the housing and extending outside of the housing.

11. The connector assembly of claim 10, wherein the cover is coupled to the housing by a hinge.

12. The connector assembly of claim 11, wherein the housing, the cover, and the hinge are a single integral component.

13. The connector assembly of claim 10, further comprising a clip coupled to the cover and configured to engage a portion of the housing defining a slot.

14. The connector assembly of claim 10, further comprising a sealing material in the channel and around the pin and configured to create an environmental seal around the pin.

15. The connector assembly of claim 14, wherein the sealing material includes an opening configured to allow the pin to extend from the channel through the opening in the sealing material and into the housing.

16. The connector assembly of claim 14, wherein the sealing material includes a raised surface surrounding the pin.

17. The connector assembly of claim 14, wherein the channel is configured to receive an insulated conductive wire, and wherein the cover is configured to apply a force against the insulated conductive wire and toward the sealing material to create the environmental seal when the cover is closed.

18. The connector assembly of claim 17, wherein the insulated conductive wire has a width substantially equal to a width of the channel.

19. The connector assembly of claim 17, wherein the pin comprises:

a pointed end in the channel configured to pierce an insulating material of the insulated conductive wire; and a bracing section configured to brace against an internal surface of the housing to retain the pin in the housing.

20. A method of using a connector assembly, comprising:

providing a housing having a first side portion and a second side portion parallel to the first side portion, the first and second side portions defining a channel therebetween, the first side portion having a first upper surface, the second side portion having a second upper surface lower than the first upper surface and having a flat side surface extending downwardly from the second upper surface, the housing comprising a cover coupled by a hinge to a first edge of the housing adjacent the first upper surface, and a pin in the channel and extending below the channel;

aligning a conductive wire over the pin;

pressing the conductive wire into the pin; and closing the cover over the conductive wire and the channel to retain the conductive wire within the channel, wherein the pressing or the closing cause the pin to pierce an insulating material of the conductive wire and electrically connect the pin to the conductive wire.

* * * * *